United States Patent [19]

Arnold

[11] Patent Number: 4,684,325

[45] Date of Patent: Aug. 4, 1987

[54] TURBOMACHINE ROTOR BLADE FIXINGS AND METHOD FOR ASSEMBLY

[75] Inventor: Hubert E. Arnold, Bristol, England

[73] Assignee: Rolls-Royce plc, London, England

[21] Appl. No.: 824,271

[22] Filed: Jan. 30, 1986

[30] Foreign Application Priority Data

Feb. 12, 1985 [GB] United Kingdom ..... 8503607

[51] Int. Cl.[4] ..... F01D 5/30; F01D 5/32; B21K 3/04; B23P 15/04

[52] U.S. Cl. ..... 416/215; 29/156.8 R

[58] Field of Search ..... 29/156.8 R; 416/215

[56] References Cited

U.S. PATENT DOCUMENTS

| | | | |
|---|---|---|---|
| 3,902,824 | 9/1975 | Sauer | 416/215 |
| 3,954,350 | 5/1976 | Zahring | 416/215 |
| 4,482,296 | 11/1984 | Wassell et al. | 416/215 |
| 4,482,297 | 11/1984 | Mosimann et al. | 416/215 X |

FOREIGN PATENT DOCUMENTS 1187227 4/1970 United Kingdom .

*Primary Examiner*—Howard N. Goldberg
*Assistant Examiner*—Ronald S. Wallace
*Attorney, Agent, or Firm*—Parkhurst & Oliff

[57] ABSTRACT

A bladed rotor assembly for a turbomachine includes a hub having a circumferential blade retaining groove and a plurality of blades which have rhombic shaped platforms. The blade retaining groove is continuous and the blades are loaded into the groove by inserting them with the generally axially directed faces of the platforms directed circumferentially. Each blade is then turned to its final operating position when the axially directed faces are axially directed and then further turned to reduce the amount of room the blade platform takes up in the circumferential direction to allow enough room for all the blades to be loaded. After all the blades are in the groove they are all turned finally to their operating positions and locked in place. A method for assembling a turbomachine rotor assembly is disclosed, also.

4 Claims, 4 Drawing Figures

Fig. 1.
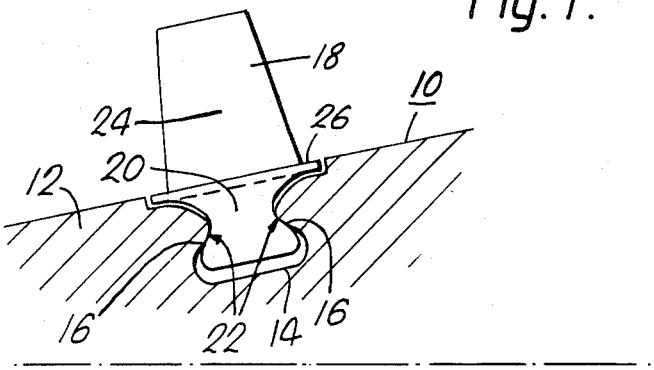
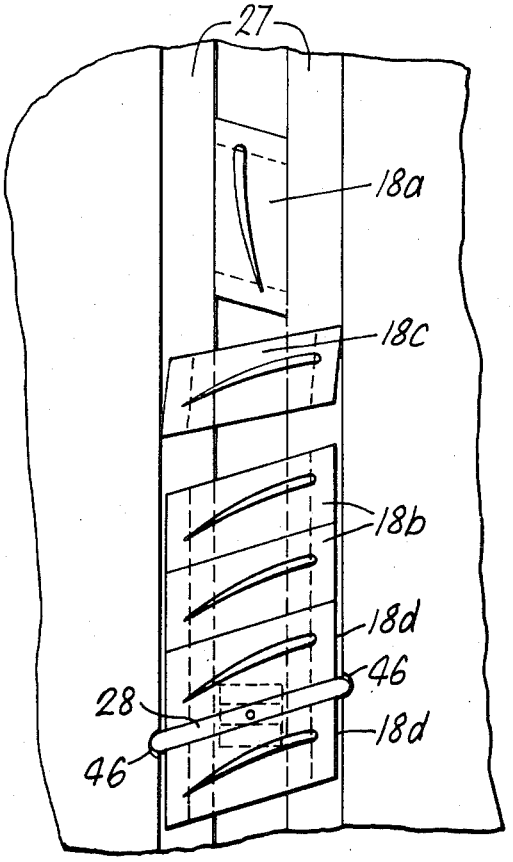
Fig. 2.

TURBOMACHINE ROTOR BLADE FIXINGS AND METHOD FOR ASSEMBLY

BACKGROUND OF THE INVENTION

This invention relates to bladed rotor assemblies of the type used in compressors and turbines of turbomachinery. More particularly, the invention relates to circumferential blade root fixings of the type employed in axial-flow compressors and turbines.

British Patent No. 1,187,227 describes a bladed rotor assembly wherein blades each with a dovetail shaped root portion, are loaded into a correspondingly shaped circumferentially extending retaining groove in the rotor hub via a loading slot in the groove. Each blade is shuffled circumferentially around the retaining groove to allow the next blade to be loaded. Usually, in this type of assembly, the final few blades to be loaded have modified platforms in order to obturate the loading slot from the gas flow through the turbomachine thereby preventing a reverse gas flow under the blade platforms adjacent the loading slot. A locking device prevents the blades moving along the groove during operation of the turbomachine.

The loading slot significantly raises the level of stress in the rotor hub and is therefore a limitation of the length of its life. A further cause of increased stress is the need to dimension the loading slot and blade root portions to half the length of the blade platform so that no part of the blade root is aligned with the loading slot after the rotor has been assembled. Ideally the blade root should extend all the way along the platform in order to make the blade as strong as possible.

Modern turbomachinery requires a greater number of blades per hub for a given size of machine for a high efficiency. To achieve this the blade platforms are of a rhombic shape as opposed to the more usual rectangular shape. These so-called 'packed rotors' have an inherent problem if the blades are loaded into the hub via a loading slot. Due to clearances between the blade roots and the walls of the retaining operation the blades assume the wrong stagger angle (or angle of attack). In doing so the rhombic shaped platform takes up less room in the circumferential direction than it would at the correct stagger angle thereby allowing extra blades to be loaded into the hub - all taking up the wrong stagger angle.

SUMMARY OF THE INVENTION

The present invention provides a bladed rotor assembly for a turbomachine which has no need for a loading slot and in which blades with rhombic shaped platforms are twisted into position in a continuous blade retaining groove.

A continuous blade retaining groove without a loading slot is preferable because of the reduced level of stress possible. Also, in a 'packed rotor' of the type described above, the possibility of loading too many blades into the retaining groove is reduced by having to twist the blades into position.

BRIEF DESCRIPTION OF THE DRAWINGS

The present invention will now be described by way of an example with reference to the accompanying drawings in which:

FIG. 1 depicts schematically a cross-section of a rotor assembly according to the present invention;

FIG. 2 illustrates a radially inward view of the rotor assembly of FIG. 1;

DESCRIPTION OF THE PREFERRED EMBODIMENT

Figure 4:
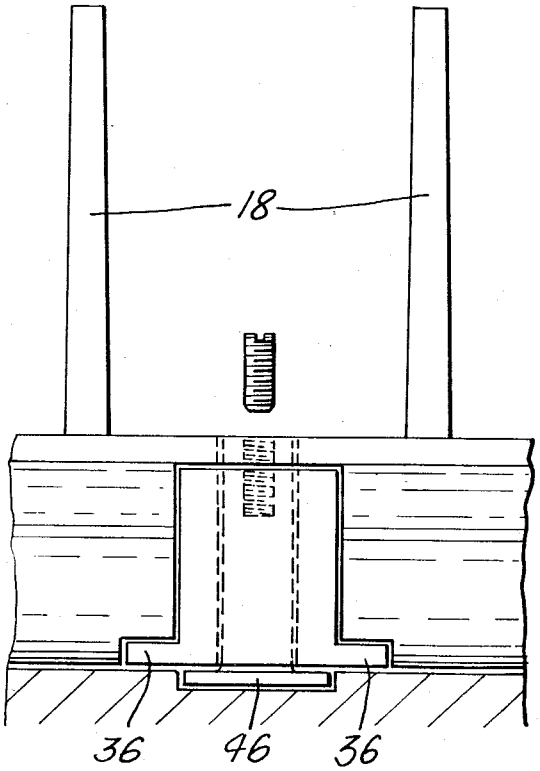
FIG. 4 shows a sectional view of the rotor assembly including the locking device of FIG. 3.

Referring to FIG. 1 there is shown part of a rotor assembly 10 incorporating the present invention. The assembly 10 comprises a hub 12 which features a circumferentially extending blade retaining groove 14. The groove 14 is of a generally dovetail section and incorporates continuous abutment surfaces 16 which retain a plurality of compressor blades 18 against centrifugal force. Each compressor blade 18 comprises a dovetail shaped root portion 20 which has generally axially directed abutment surfaces 22 to engage surfaces 16 of groove 14, an aerofoil portion 24 and a rhombic shaped platform 26. By having a rhombic shaped platform 26 it is possible to have a 'packed' rotor which features a higher number of blades 18 per hub than if the platforms 26 were of rectangular shape. Each platform locates in a recess 27 in order that it is flush with the hub 12. The root portion 20 of each blade 18 extends all the way along the platform 26 in the circumferential direction thereby reducing the possibility of a reverse gas flow occuring under the blade platforms 26 between adjacent root portions.

Referring now to FIG. 2 each blade 18 is loaded into the blade retaining groove 14, by inserting it with the surfaces 22 directed generally circumferentially as shown by the position of blade 18*a*. The blade is then turned to its predetermined operating position 18*b* and then further turned to the position 18*c*. In position 18*c* the blade platform 26 takes up less room in the circumferential direction thereby providing enough room for all the blades to be loaded into the groove 14. After all the blades 18 have been loaded in the same manner they are all turned back to the operating position of 18*b*. In the operating position the aerofoil portion 24 of each blade is at the correct stagger angle.

It should be noted that the blades 18 are so dimensioned to allow a clearance between the root portion 20 of each blade and the retaining groove 14. This clearance allows the blades 18 to be turned past their operating position. When the rotor assembly 10 is rotated centrifugal force acts on the blades 18 to cause the abutment surfaces 16 and 22 of the groove 14 and blade root 20 respectively to come into contact with each other.

As shown in FIG. 2 it is also necessary for the groove 14 to be of sufficient width to allow each blade 18 to be fitted between the jaws of the groove before it is turned to the operating position.

To prevent the blades 18 from shuffling along the groove 14 during rotation of the rotor assembly 10 and also to constrain the blades 18 at the correct stagger angle a plurality of locking devices 28 are provided.

Figure 3:
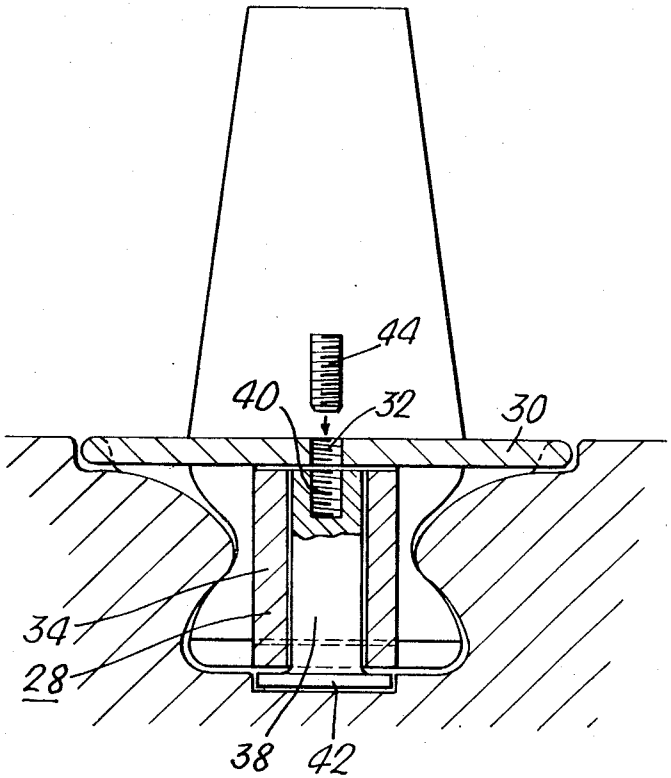
FIG. 3 shows a locking device used in the rotor assembly.

Referring to FIG. 3, each locking device 28 comprises a filler member 30, provided with a threaded hole 32, a threaded nut 34 provided with flanges 36 and a bolt 38. The bolt 38 has a concentric threaded hole 40 of the same size as hole 32 in the filler member 30. The bolt 38 also has a head portion 42. The locking device 28 further comprises a grub screw 44.

During loading of the blades 18, the nut 34 and bolt 38 are loaded into the groove 14 between modified blades 18*d*. The blades 18*d* are modified in that they have cut-outs in the root portion 20 to accommodate the flanges 36 of the nut 34, and the platforms 26 are of reduced width. When all the blades 18 have been loaded the nut 34 and the bolt 38 together with adjacent blades 18*d* are aligned so that the filler member 30 may be inserted into cut-outs 46 in the hub 12. The grub screw 44 is then screwed into the threaded hole 32 and further screwed into the hole 40 of the bolt 38. After which, further turning the grub screw 44 will cause the bolt 38 to turn in the nut 36 thereby allowing the bolt head 42 to abut against the bottom of the groove 14 in a recess 46 and the flanges 36 of nut 34 to abut against the root portions of adjacent blades 18*d* as shown in FIGS. 3 and 4.

After all the locking devices 28 have been loaded and assembled the grub screws 44 may be peaned over to prevent them from unscrewing.

To disassemble the rotor assembly 10 the reverse of the assembly method is employed after removing all of the locking devices. It will probably be necessary to drill out the grub screws and then remove the filler member 30 and loosen off the nut 34 and bolt 38.

To ensure that after the hub has been assembled and all the blades have been turned to their final positions there are no substantial clearances between adjacent platforms 26 it is possible to vary the dimensions of the platforms from a nominal value. For instance, some of the blades' platforms may be slightly larger than the nominal size and some slightly smaller in the circumferential direction. Therefore by selecting a combination of blade platform sizes it can be ensured that after assembly there is only a small clearance or none at all between adjacent blade platforms 26.

I claim:

1. A bladed rotor assembly for a turbomachine comprising:

a blade retaining groove, generally dovetailed in cross-section, extending circumferentially around a periphery of a rotatable hub, the groove comprising at least one continuous blade retaining abutment surface facing in a generally radially inward direction; and a plurality of blades each comprising a root portion generally dovetailed in cross-section, a platform of generally rhombic shape having two side abutment faces for contact with side abutment faces of adjacent blades, and an aerofoil, the root portion comprising at least one generally radially outward facing abutment surface adapted to engage a corresponding blade retaining abutment surface in the retaining groove to thereby retain the blade in the groove;

wherein each blade root portion is shaped in relation to the blade retaining groove to provide a clearance therebetween to facilitate twisting of the blade with respect to the hub.

2. The bladed rotor assembly according to claim 1, further comprising locking means located in the retaining groove between two adjacent blades for preventing circumferential movement of the blades.

3. A method of assembling a turbomachine rotor assembly which includes a blade retaining groove, generally dovetailed in cross-section, extending circumferentially around a periphery of a rotatable hub, the groove comprising at least one continuous blade retaining abutment surface facing in a generally radially inward direction; and a plurality of blades each comprising a root portion generally dovetailed in cross-section, a platform of generally rhombic shape having two side abutment faces for contact with side abutment faces of adjacent blades, and an aerofoil, the root portion including at least one generally radially outward facing abutment surface adapted to engage a corresponding blade retaining abutment surface in the retaining groove to thereby retain the blade in the groove, each blade root portion being shaped in relation to the blade retaining groove so as to provide a clearance therebetween to facilitate twisting of the blade with respect to the hub; the method comprising the steps of:

inserting each blade into the retaining groove with the side abutment faces extending in a generally circumferential direction;

twisting each blade relative to the hub after insertion to a predetermined operating position and further twisting it by taking up at least some of the clearance between the blade root portion and the blade retaining groove to thereby reduce the circumferential space taken up by the platform; and when all the blades are inserted in the groove, twisting each blade back to its operating position.

4. The method of assembling a rotor assembly according to claim 3, further comprising the step of fitting locking means in the retaining groove between two adjacent blades to prevent circumferential movement of the blades.

* * * * *